US007667613B2

(12) United States Patent
Stevens et al.

(10) Patent No.: US 7,667,613 B2
(45) Date of Patent: Feb. 23, 2010

(54) EVACUATION STATUS MODULE (ESM)

(75) Inventors: Saundra Janese Stevens, West Union, OH (US); Robert Glenn Fuller, West Union, OH (US)

(73) Assignee: Evis LLC, West Union, OH (US)

( * ) Notice: Subject to any disclaimer, the term of this patent is extended or adjusted under 35 U.S.C. 154(b) by 352 days.

(21) Appl. No.: 11/764,198

(22) Filed: Jun. 16, 2007

(65) Prior Publication Data

US 2008/0018500 A1 Jan. 24, 2008

Related U.S. Application Data

(60) Provisional application No. 60/816,483, filed on Jun. 27, 2006.

(51) Int. Cl.

| | |
|---|---|
| ***G08B 3/00*** | (2006.01) |
| ***G08B 5/00*** | (2006.01) |
| ***G08B 7/00*** | (2006.01) |
| ***G08B 23/00*** | (2006.01) |
| ***G08B 5/36*** | (2006.01) |
| ***G09F 13/00*** | (2006.01) |
| ***G08B 21/00*** | (2006.01) |
| ***G09F 9/00*** | (2006.01) |

(52) U.S. Cl. ..... 340/691.1; 340/693.6; 340/815.53; 340/825.49; 116/100; 116/307

(58) Field of Classification Search ..... 340/500–514, 340/321, 532, 539.14, 539.16–539.19, 539.26, 340/693.5–693.7, 3.7, 3.71, 3.1, 3.9, 825.19, 340/825.36, 825.49, 286.02, 286.04–286.11, 340/691.1–691.6, 287, 288, 300, 815.53, 340/815.54; 116/4, 5, 67 R, 100, 306, 307, 116/309; 40/616, 610–612, 124.09–124.19, 40/312, 313, 530–537, 672, 571, 574, 584

See application file for complete search history.

(56) References Cited

U.S. PATENT DOCUMENTS

| | | | | |
|---|---|---|---|---|
| 3,531,794 | A * | 9/1970 | Goerner | 340/297 |
| 3,975,724 | A * | 8/1976 | Schultz | 340/286.08 |
| 4,253,260 | A * | 3/1981 | Maza et al. | 40/610 |
| 5,235,933 | A | 8/1993 | Paré | |
| 5,309,146 | A | 5/1994 | Kenet | |
| 5,347,735 | A | 9/1994 | Pratt | |
| 5,358,762 | A | 10/1994 | McGrath | |
| 5,860,386 | A * | 1/1999 | Schwab et al. | 116/63 P |
| 5,861,806 | A | 1/1999 | Vories | |
| 6,236,303 | B1 | 5/2001 | Wagner | |
| 6,367,180 | B2 * | 4/2002 | Weiss et al. | 40/580 |
| 6,771,181 | B1 * | 8/2004 | Hughen, Jr. | 340/693.5 |
| 6,860,629 | B2 * | 3/2005 | Velez | 362/559 |
| 7,271,704 | B2 | 9/2007 | McSheffrey | |
| 7,378,982 | B2 * | 5/2008 | Mohamed | 340/691.6 |
| 2002/0149492 | A1 * | 10/2002 | Buckingham et al. | 340/691.6 |
| 2004/0255497 | A1 * | 12/2004 | Venkataraman et al. | 40/551 |
| 2005/0212677 | A1 * | 9/2005 | Byrne et al. | 340/574 |
| 2008/0016730 | A1 | 1/2008 | Topitzes | |

* cited by examiner

*Primary Examiner*—Jennifer Mehmood
(74) *Attorney, Agent, or Firm*—Porter, Wright, Morris & Arthur, LLP

(57) ABSTRACT

A new device used in institutions such as, but not limited to, hospitals, nursing homes, and other patient-care facilities, and hotels and cruise ships which, when activated, provides a visual indication locally, at or near the room to which it is attached, and remotely at a central control station and/or hand held device, as to whether or not a particular room has been evacuated during an emergency evacuation situation.

20 Claims, 2 Drawing Sheets

"Active State"

Evacuation Status Module (ESM)

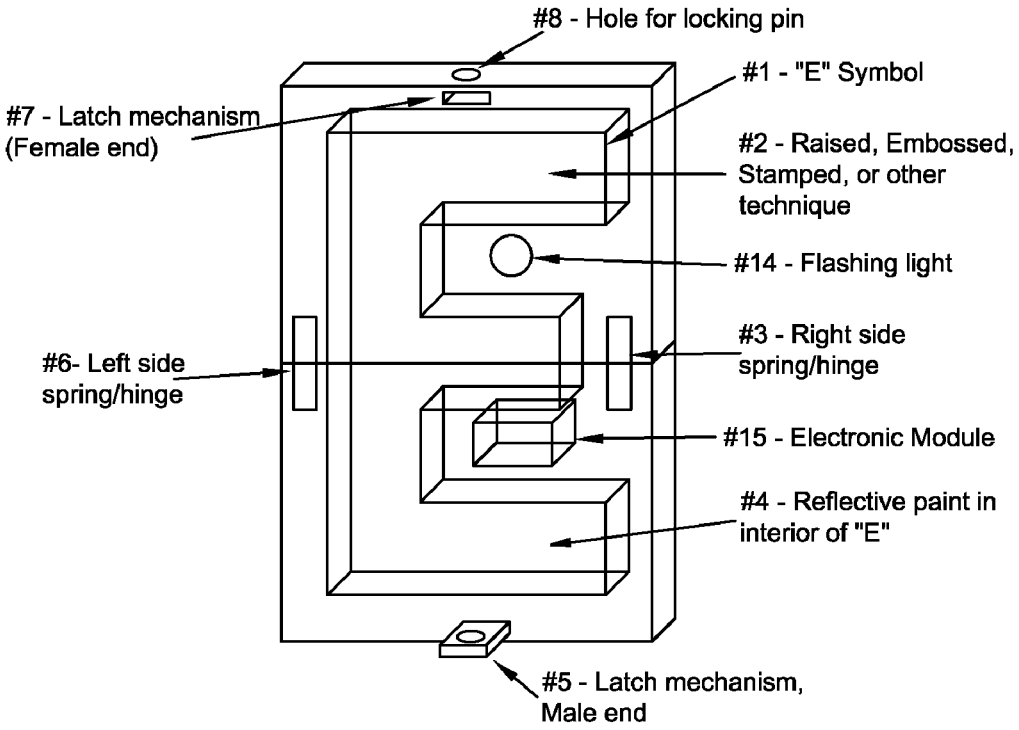
Figure 1 - "Active State"
Evacuation Status Module (ESM)

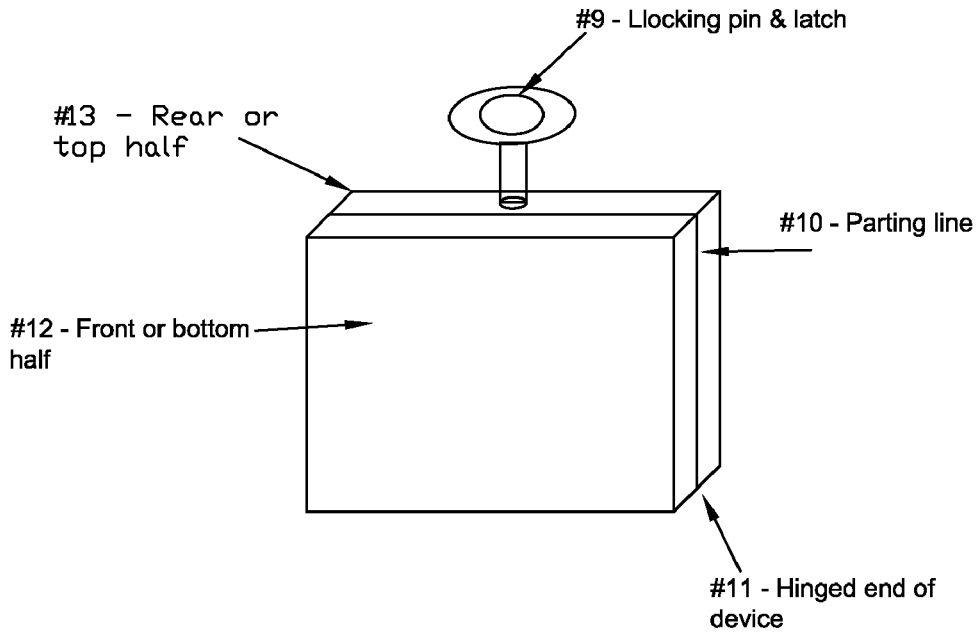
Figure 2 - "Inactive State"
Evacuation Status Module (ESM)

EVACUATION STATUS MODULE (ESM)

CROSS-REFERENCE TO RELATED APPLICATIONS

This application claims priority of provision application No. 60/816,483 filed on Jun. 27, 2006.

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISC APPENDIX

Not applicable

BACKGROUND OF THE INVENTION

Many hospitals and nursing homes are required by State, Federal, and International laws to establish and document emergency evacuation procedures. In the case of a fire emergency, these institutions are required, among other things, to document a method for evacuating all patients from their rooms to a safe area. One critical aspect of the evacuation process is effective communication among staff as to which rooms have been evacuated. State, Federal, and in some cases, International regulations leave the method of communication up to each institution's administration. As such, several techniques have been developed. These include, but are not limited to, the use of pillow cases left on the floor outside the evacuated room, orange tags placed on a hook on the outside of the door of the evacuated room, and the use of a chalk mark on the outside of the door of the evacuated room. Each of these communication systems has weaknesses and does not provide the most efficient method of communicating the evacuation status of the affected room. These methods put patients, staff, and rescue personnel at unnecessary risk. In general, the shortcomings of each of these devices and other similar devices not mentioned here, are the following:

1. Require retrieval from some storage location—The current methods utilize items that are not located at the point of use. Therefore they have to be retrieved at the time of the emergency. This takes valuable time away from the evacuation process.
2. Items utilized could be misplaced—The items utilized in the current methods are not affixed to the point of use possibly resulting in being misplaced and not available at the time of the emergency.
3. Application of the method is clumsy and/or difficult—Getting the pillowcase off of the pillow is clumsy and placing a sign on a hook can be difficult in a tense situation thus again wasting valuable time.
3. These methods and devices may not hold up to either the heat from a fire (in the case of the chalk or the sign) or the traffic of the evacuation process (in the case of a pillow case on the floor). In either case, the indicator is rendered inadequate resulting in no communication to other evacuation personnel.
4. These methods and devices would be difficult to see in conditions of poor visibility (i.e. smoke or dim to no light).
5. These devices do not provide an efficient means of communicating the evacuation status of each room to which they are employed at a location other than at the location (room) on which they are being used. They cannot communicate to a remote location or remote devices where the evacuation status of rooms can be strategically used to manage a mass evacuation of a facility. As a result, rescue personnel and/or staff must return to and/or enter a dangerous area to evaluate the area for evacuation status of the occupants.

The device proposed in this application provides a consistent, efficient method for indicating the evacuation status of the room to which it is attached. Once triggered, it will indicate that the room to which it is attached has been evacuated in the following ways:

A) Physical, visual indication hanging on, or near, a door to a particular room displaying an evacuation symbol common to those in the building B) Either one or both of the following, wireless or via low voltage hard wired communication signal to a central control station and/or hand held devices.

It will improve the evacuation process of institutions where it is used and will save lives of patients, staff, and rescue personnel by eliminating duplicate searches of rooms previously evacuated.

BRIEF SUMMARY OF THE INVENTION

The Evacuation Status Module (ESM) is a device, which, when activated, indicates that the room to which it is attached, has been evacuated of all occupants. Use of the ESM saves lives by saving rescue personnel valuable time during an emergency evacuation. It eliminates the need to search a room that has already been evacuated and electronically updates facility control stations and/or hand held devices as to the status of the evacuation process throughout the facility. As a result, rescue personnel can proceed to other rooms or areas of the affected premises that have not been evacuated. Furthermore, staff and/or rescue personnel can utilize the real-time data at either the main facility control station or on handheld devices, (or both), to strategically carry out the evacuation process in the most efficient manner possible. The ESM is mounted on the exterior side of a room near or on the room's exit door. During an evacuation situation, when all occupants have been removed from (or have exited) the room, the ESM is manually activated. It then serves as an indicator to anyone searching or evacuating at a later time that the room is empty.

This device solves problems with other methods by providing:

1. Easy access (i.e. The device does not have to be retrieved to be used. It is mounted to the outside of the door or adjacent frame.),
2. Known whereabouts at all times,
3. Simple application (press of a button),
4. Durability in extreme conditions (i.e. The device will hold up to extreme conditions such as heat [made of heat resistant material such as metal, composite, or high temperature polymer]
5. High visibility (i.e. The device is coated with a highly visible reflective coating such as heat resistant paint, anodized coating, or other mechanically or electrodeposited coating which makes it more able to be seen in poor visibility conditions (i.e. smoke or dim-to-no light).
6. Provides instant, real-time, information to staff and rescue personnel via a facility's central control system or handheld devices, or both, to allow them to strategically carry out the evacuation process in the most efficient manner possible.

BRIEF DESCRIPTION OF THE SEVERAL VIEWS OF THE DRAWING

FIG. 1 is a perspective of the Evacuation Status Indicator in the "open" or "activate" state FIG. 2 is a perspective of the Evacuation Status Indicator in the "closed", or "inactive" state

DETAILED DESCRIPTION OF THE INVENTION

Referring to FIG. 2, the invention can be seen in the "inactive" state. The invention is shown to be a rectangular cube, however to anyone skilled in the art, this could be shaped in any number of three-dimensional forms. In the closed state, the invention is shown to have two halves with the front (or bottom) half 12 separated from the rear (or top) half 13 by parting line 10. The rear (or top) half 13 is rigidly connected to a wall (or door) while the front (or bottom) half 12 is not. The device is activated by pulling the locking pin 9 from the latch. The locking pin and latch 9 is shown as a non-descript latch mechanism. As such, the locking pin and latch 9 can be any number of latch mechanisms common to anyone skilled in the field of latches. When the locking pin 9 is pulled, the device opens along parting line 10 by rotating about the hinged end of the device 11. The device can be seen in the "activate" state in FIG. 1. The "activate" state of the device reveals the letter "E" 1 in the form of a cavity 2 on the inside of the device.

The letter "E" was selected for this drawing, however the visual stimulus could be any letter, symbol, sign, or other rendering common to the field of emergency protocol, personnel in the field of emergency protocol, and/or that which is compliant with local, state, federal, or national codes. For the purposes of this application, it is shown in FIG. 1 as the letter "E" 1.

The "E" 1 serves as a visual and palpable indicator that the room has been evacuated. The "E" 1 has a coating 4 that is capable of withstanding high temperatures and has a reflective appearance when subjected to a light source. The nature of this coating is such that it enhances visibility in times of poor visibility such as dark or smoky conditions. The colors selected are those common to the field of emergency protocol, personnel in the field of emergency protocol, and/or in compliance with local, state, federal, or national codes. This could include highly visible and reflective coatings. Connecting the rear (or top) half of the device 13 to the front (or bottom) half of the device 12 are the left side mechanical energy storage device/hinge 6 and the right side mechanical energy storage device/hinge 3. For simplicity, these mechanical energy storage devices will be referred to as "spring hinges". The purpose of these two spring hinges is to cause the closed device 10 to spring open 6 and stay open until such time as an authorized person returns the device to the "inactive" state.

Also visible in the "active" state is the high intensity flashing light 14. This light 14 begins to flash when the device is activated. This light 14 provides an additional visible indication that the room to which the device is attached has been evacuated and can be used to signal other conditions based on the color it is flashing. Not visible in either the active state or the inactive state is the electronic module 15. This electronic module 15 is a collection of electronics which, when the device is activated, produces a signal (carried by either a wired and/or wireless connection). This signal is carried to the facility's central control station for recording, viewing and/or monitoring. The electronic module 15 is powered either by alternating current (AC) or direct current (DC) supply. This power can be connected to the same circuitry as the facilities other emergency equipment. The signal is generated by the module's emitter. This signal is also received at the facility's central control station, and it can also be received on handheld units carried by facility personnel and/or rescue personnel. It is understood by anyone knowledgable to the industry that this signal can be carried by, but not limited to, conventional and/or current methods such as infrared, wi-fi, bluetooth, radio or other such communication means of electronic communication (hard-wired, wireless, fiber-optic, or otherwise).

We claim:

1. An evacuation indicating device comprising:

first and second components affixed together and moveable relative to one another between an open state wherein a visual stimulus recognizable by personnel in the field of emergency protocol is visible to indicate that evacuation has occurred and a closed state wherein the visual stimulus is not visible;

wherein the first component is mounted at an exterior side of an interior room near an exit door of the interior room;

a latch mechanism removably holding the first and second components in the closed state until an external input is selectively applied to move the first and second components to the open state; and an electronic module automatically emitting a signal to a remote control station when the first and second components are moved to the open state to indicate to emergency personnel at the control station the evacuation status of the interior room.

2. The evacuation indicating device according to claim 1, wherein the first and second components are hinged together.

3. The evacuation indicating device according to claim 1, wherein the first and second components are hinged together about a horizontal pivot axis at the bottom of the first component so that the second component overlies the first component in the closed state and a top of the second component pivots downward and outward about the pivot axis to a position located below the first component in the open state.

4. The evacuation indicating device according to claim 1, wherein the visual stimulus is one of embossed and debossed in the first and second components so that personnel in the field of emergency protocol can alternatively feel the visual stimulus in poor visibility conditions.

5. The evacuation indicating device according to claim 1, wherein the first and second components comprise a heat resistant material.

6. The evacuation indicating device according to claim 5, wherein the first and second components comprise metal and the visual stimulus is formed in the metal.

7. The evacuation indicating device according to claim 1, wherein the visible stimulus is provided with a reflective coating.

8. The evacuation indicating device according to claim 1, wherein the visible stimulus comprises at least one of an alphanumeric character, sign, symbol, and rendering.

9. The evacuation indicating device according to claim 1, wherein the visible stimulus is comprised of a single alphanumeric character.

10. The evacuation indicating device according to claim 9, wherein the first and second components each form a portion of the single alphanumeric character.

11. The evacuation indicating device according to claim 1, further comprising a light indicating the status of the device.

12. The evacuation indicating device according to claim 1, wherein the signal is carried by one of a wired and wireless connection.

13. The evacuation indicating device according to claim 1, wherein the signal is relayed to at handheld receivers.

14. The evacuation indicating device according to claim 1, wherein the signal is unique to the device to indicate the interior room to which the device is assigned.

15. An evacuation indicating system comprising:

a plurality of evacuation indicating devices mounted at exterior sides of interior rooms near exit doors of the interior rooms;

each evacuation indicating device including:

first and second components affixed together and moveable relative to one another between an open state wherein a visual stimulus recognizable by personnel in the field of emergency protocol is visible to indicate that evacuation has occurred and a closed state wherein the visual stimulus is not visible;

a latch mechanism removably holding the first and second components in the closed state until an external input is selectively applied to move the first and second components to the open state; and an electronic module automatically emitting a signal to a remote control station when the first and second components are moved to the open state to indicate to emergency personnel at the control station the evacuation status of the interior room associated with the evacuation indicating device.

16. The evacuation indicating system according to claim 15, wherein each evacuation indicating device further comprises a light indicating the status of the evacuation indicating device.

17. The evacuation indicating system according to claim 15, wherein the visible stimulus comprises an alphanumeric character and the first and second components each form a portion of the alphanumeric character.

18. The evacuation indicating system according to claim 15, wherein the signal of each evacuation indicating device is unique to the associated evacuation indicating device to indicate the interior room to which the associated evacuation indicating device is assigned.

19. The evacuation indicating system according to claim 15, wherein each of the signals is carried by one of a wired and wireless connection.

20. The evacuation indicating system according to claim 15, wherein each of the signals is relayed to handheld receivers.

* * * * *